US012187976B2

(12) United States Patent
Shimamoto et al.

(10) Patent No.: US 12,187,976 B2
(45) Date of Patent: Jan. 7, 2025

(54) MIXED POWDER FOR POWDER METALLURGY

(71) Applicant: JFE STEEL CORPORATION, Tokyo (JP)

(72) Inventors: Hanako Shimamoto, Tokyo (JP); Ryosuke Matsuoka, Tokyo (JP); Kohsuke Ashizuka, Tokyo (JP); Shigeru Unami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 600 days.

(21) Appl. No.: 17/594,561

(22) PCT Filed: Jan. 28, 2020

(86) PCT No.: PCT/JP2020/003003

§ 371 (c)(1),
(2) Date: Oct. 22, 2021

(87) PCT Pub. No.: WO2020/217618

PCT Pub. Date: Oct. 29, 2020

(65) Prior Publication Data

US 2023/0158565 A1 May 25, 2023

(30) Foreign Application Priority Data

Apr. 23, 2019 (JP) ..... 2019-082258
Jul. 19, 2019 (WO) ..... PCT/JP2019/028551

(51) Int. Cl.

| | |
|---|---|
| ***B22F 1/10*** | (2022.01) |
| ***B22F 1/00*** | (2022.01) |
| ***B22F 1/08*** | (2022.01) |
| ***B22F 1/102*** | (2022.01) |
| ***B22F 1/105*** | (2022.01) |
| ***B22F 1/16*** | (2022.01) |
| ***B22F 1/17*** | (2022.01) |
| ***C10M 115/04*** | (2006.01) |
| ***C10M 115/08*** | (2006.01) |
| ***C10M 169/04*** | (2006.01) |
| *C10N 40/20* | (2006.01) |

(52) U.S. Cl.

CPC ..... *C10M 169/04* (2013.01); *B22F 1/00* (2013.01); *B22F 1/08* (2022.01); *B22F 1/09* (2022.01); *B22F 1/10* (2022.01); *B22F 1/102* (2022.01); *B22F 1/105* (2022.01); *B22F 1/16* (2022.01); *B22F 1/17* (2022.01); *C10M 115/04* (2013.01); *C10M 115/08* (2013.01); *B22F 2301/10* (2013.01); *B22F 2301/35* (2013.01); *C10M 2207/1265* (2013.01); *C10M 2207/2815* (2013.01); *C10M 2207/2835* (2013.01); *C10M 2207/2895* (2013.01); *C10M 2215/265* (2013.01); *C10M 2215/285* (2013.01); *C10N 2040/246* (2020.05)

(58) Field of Classification Search
None
See application file for complete search history.

(56) References Cited

U.S. PATENT DOCUMENTS

| | | | | |
|---|---|---|---|---|
| 5,279,640 | A * | 1/1994 | Ogura | B22F 1/10 75/343 |
| 5,989,304 | A * | 11/1999 | Ozaki | B22F 1/102 75/252 |
| 6,235,076 | B1 | 5/2001 | Ozaki et al. | |
| 6,395,688 | B2 | 5/2002 | Vidarsson | |
| 7,867,314 | B2 | 1/2011 | Ono et al. | |
| 2001/0029808 | A1 | 10/2001 | Vidarsson | |
| 2010/0224025 | A1* | 9/2010 | Ono | B22F 1/108 75/252 |
| 2011/0265602 | A1* | 11/2011 | Ahlin | B22F 1/102 977/773 |

FOREIGN PATENT DOCUMENTS

| | | | |
|---|---|---|---|
| CN | 1373684 | A | 10/2002 |
| CN | 101801566 | A | 8/2010 |
| JP | H10280005 | A | 10/1998 |
| JP | H10317001 | A | 12/1998 |
| JP | 2003509581 | A | 3/2003 |
| JP | 2005307348 | A | 11/2005 |

(Continued)

OTHER PUBLICATIONS

English translation of JPH 10-280005-A (originally published Oct. 20, 1998), obtained from PE2E search.*
English translation of JP 2012-167302-A (originally published Sep. 6, 2012), obtained from PE2E search.*
Nov. 5, 2022, Office Action issued by the Korean Intellectual Property Office in the corresponding Korean Patent Application No. 10-2021-7034405 with English language concise statement of relevance.
Nov. 22, 2022, Office Action issued by the China National Intellectual Property Administration in the corresponding Chinese Patent Application No. 202080030305.0 with English language search report.
Sep. 1, 2022, Office Action issued by the Canadian Intellectual Property Office in the corresponding Canadian Patent Application No. 3,134,580.

(Continued)

*Primary Examiner* — George Wyszomierski
(74) *Attorney, Agent, or Firm* — KENJA IP LAW PC

(57) ABSTRACT

A mixed powder for powder metallurgy comprises: an iron-based powder; and a lubricant, wherein the lubricant consists of a low-melting-point lubricant having a melting point of 86° C. or less and a high-melting-point lubricant having a melting point of more than 86° C., the low-melting-point lubricant has at least one of an amide group, an ester group, an amino group, and a carboxyl group, a ratio R1 of the low-melting-point lubricant to whole of the lubricant is 5 mass % or more and less than 90 mass %, a ratio R2 of a mass of a free lubricant to a mass of a binding lubricant is 0 or more and 15 or less, and an amount R3 of the low-melting-point lubricant contained as the free lubricant is less than 0.10 parts by mass with respect to 100 parts by mass of the iron-based powder.

14 Claims, No Drawings

(56) References Cited

FOREIGN PATENT DOCUMENTS

| | | | |
|---|---|---|---|
| JP | 2009035119 | A1 | 3/2009 |
| JP | 2010059517 | A | 3/2010 |
| JP | 2011184708 | A | 9/2011 |
| JP | 2012167302 | A | 9/2012 |

OTHER PUBLICATIONS

Jan. 26, 2021, Notification of Reasons for Refusal issued by the Japan Patent Office in the corresponding Japanese Patent Application No. 2020-515265 with English language Concise Statement of Relevance.
Mar. 3, 2020, International Search Report issued in the International Patent Application No. PCT/JP2020/003003.
Apr. 22, 2022, the Extended European Search Report issued by the European Patent Office in the corresponding European Patent Application No. 20794985.0.

* cited by examiner

MIXED POWDER FOR POWDER METALLURGY

TECHNICAL FIELD

The present disclosure relates to a mixed powder for powder metallurgy, and particularly to a mixed powder for powder metallurgy that combines excellent fluidity and excellent ejection properties and compressibility during compaction.

BACKGROUND

Powder metallurgy technology is a method with which parts having complex shapes can be compacted in shapes very close to product shapes and can be produced with high dimensional accuracy. Powder metallurgy technology can also significantly reduce cutting costs. Therefore, powder metallurgical products are widely used as all kinds of machines and parts.

Powder metallurgy uses a mixed powder (hereinafter referred to as "mixed powder for powder metallurgy" or simply "mixed powder") obtained by mixing an iron-based powder, which is a main raw material, optionally with an alloying powder such as copper powder, graphite powder, or iron phosphide powder, a powder for improving machinability such as MnS, and a lubricant.

The lubricant contained in the mixed powder for powder metallurgy plays an extremely important role when the mixed powder for powder metallurgy is subjected to compaction to yield a product. The effects of the lubricant will be described below.

First, the lubricant has a lubrication effect when the mixed powder is subjected to compaction in a die. The lubrication effect is further roughly divided into the following two. One is the effect of reducing the friction between particles contained in the mixed powder. During the compaction, the lubricant enters between the particles and reduces the friction, thereby promoting the rearrangement of the particles. The other is the effect of reducing the friction between the die used for compaction and the particles. The lubricant on the surface of the die enters between the die and the particles, thereby reducing the friction between the die and the particles. With these two effects, the mixed powder can be compressed to high density during the compaction.

The lubricant also has a lubrication effect when a green compact formed by subjecting the mixed powder to compaction in the die is taken (ejected) out of the die. Typically, the green compact is ejected out of the die by pushing it out with a punch, where large frictional resistance is generated due to the friction between the green compact and the surface of the die. Some of the lubricant contained in the mixed powder on the surface of the die reduces this frictional force.

As described above, the lubricant contained in the mixed powder for powder metallurgy plays a very important role during the compaction. However, the lubricant is only required during the compaction and the ejection out of the die and is unnecessary after the ejection. Further, it is desirable that the lubricant disappears during the sintering of the green compact so that no lubricant will remain in a final sintered body.

In addition, since the lubricant typically has stronger adhesive power than the iron-based powder, the lubricant deteriorates the fluidity of the mixed powder. Moreover, since the lubricant has a lower specific gravity than the iron-based powder, the density of the green compact decreases when a large amount of lubricant is added.

Furthermore, the lubricant used in the mixed powder for powder metallurgy is required to function as a binder in some cases. The binder here refers to a component that allows an alloying powder and other additive components to adhere to the surface of the iron-based powder which is a main component. A typical mixed powder for powder metallurgy is obtained by simply mixing an iron-based powder with additive components such as an alloying powder, a powder for improving machinability, and a lubricant. However, each component may segregate inside the mixed powder in this state. In particular, graphite powder, which is typically used as an alloying powder, tends to segregate when the mixed powder is flowed or vibrated because it has a lower specific gravity than other components. In order to prevent such segregation, it has been proposed that the additive components be adhered to the surface of the iron-based powder via a binder. Such a powder is one type of mixed powder for powder metallurgy, and is also referred to as a segregation prevention treatment powder. The segregation prevention treatment powder has the additive components adhered to the iron-based powder, thereby preventing the above-described segregation of components.

The binder used in such a segregation prevention treatment powder usually is a compound that also functions as a lubricant. This is because, by using a binder also having lubricity, the total amount of the binder and the lubricant added to the mixed powder can be reduced.

Typically, such a mixed powder for powder metallurgy is subjected to press forming at a pressure of 300 MPa to 1000 MPa into a certain part shape, and then sintered at a high temperature of 1000° C. or more into a final part shape. In this case, the total amount of the lubricant and the binder contained in the mixed powder is usually about 0.1 parts by mass to 2 parts by mass with respect to 100 parts by mass of the iron-based powder. In order to increase the density of the green compact, the amount of the lubricant and the binder added is preferably small. Therefore, the lubricant is required to exhibit excellent lubricity in a small amount.

The lubricity of the lubricant is greatly influenced by the melting point of the compound contained in the lubricant. If the lubricant contains a compound having a relatively low melting point, the lubricant tends to seep from the inside of the mixed powder to the wall surface of the die during the compaction as compared with a lubricant containing only a compound having a high melting point, so that the ejection properties and the compressibility are improved.

However, it is known that the fluidity of the mixed powder degrades in the case where only a low-melting-point lubricant is used. In order to achieve all of the fluidity of the mixed powder, the ejection properties during the compaction, and the compressibility of the green compact, techniques of using a low-melting-point lubricant and a high-melting-point lubricant together have been proposed.

For example, JP 2005-307348 A (PTL 1) proposes using, as a free lubricant, a lubricant obtained by subjecting a mixture of a compound with a relatively low melting point such as oleamide or erucamide and a compound with a high melting point such as ethylenebisstearamide to melt injection to be in a spherical shape.

JP 2003-509581 A (PTL 2) proposes using, as a free lubricant, a lubricant containing metastable phase formed by rapid cooling a melt mixture of oleamide with a low melting point and ethylenebisstearamide with a high melting point.

JP 2011-184708 A (PTL 3) proposes using, as a free lubricant, a first lubricant with a melting point of 50° C. to 120° C. and a second lubricant with a melting point of 140° C. to 250° C.

CITATION LIST

Patent Literature

PTL 1: JP 2005-307348 A
PTL 2: JP 2003-509581 A
PTL 3: JP 2011-184708 A

SUMMARY

Technical Problem

With the technique proposed in PTL 1, in order to produce the lubricant, two lubricants with different melting points need to be melt mixed and then subjected to melt injection to be in a spherical shape. With the technique proposed in PTL 2, in order to produce the lubricant containing metastable phase, two lubricants with different melting points need to be melt mixed and then rapid cooled. Thus, each of these techniques requires a special process for the production of the lubricant, which causes an increase in production costs.

With the technique proposed in PTL 3, a lubricant having a circularity of 0.9 or more needs to be used as the first lubricant. In order to produce a lubricant having a circularity of 0.9 or more, a special method such as spray-drying is required, which causes an increase in production costs.

It could therefore be helpful to provide a mixed powder for powder metallurgy that combines all of the fluidity of the mixed powder, the ejection properties during compaction, and the compressibility of the green compact, using a readily available lubricant without any constraints on the lubricant production process.

Solution to Problem

We thus provide the following.

1. A mixed powder for powder metallurgy, comprising: an (a) iron-based powder; and a (b) lubricant, wherein the (b) lubricant contains a fatty acid metal soap, the (b) lubricant consists of a low-melting-point lubricant having a melting point of 86° C. or less and a high-melting-point lubricant having a melting point of more than 86° C., the low-melting-point lubricant has at least one selected from the group consisting of an amide group, an ester group, an amino group, and a carboxyl group, a ratio R1 of the low-melting-point lubricant to whole of the (b) lubricant is 5 mass % or more and less than 90 mass %, a ratio R2 of a mass of a (b2) free lubricant to a mass of a (b1) binding lubricant is 0 or more and 15 or less, where the (b1) binding lubricant is the (b) lubricant adhering to a surface of the (a) iron-based powder, and the (b2) free lubricant is the (b) lubricant not adhering to the surface of the (a) iron-based powder, and an amount R3 of the low-melting-point lubricant contained as the (b2) free lubricant is less than 0.10 parts by mass with respect to 100 parts by mass of the iron-based powder.
2. A mixed powder for powder metallurgy, comprising: an (a) iron-based powder; a (b) lubricant; and at least one of (c) carbon black and a (d) carbonate, wherein the (b) lubricant does not contain a fatty acid metal soap, the (b) lubricant consists of a low-melting-point lubricant having a melting point of 86° C. or less and a high-melting-point lubricant having a melting point of more than 86° C., the low-melting-point lubricant has at least one selected from the group consisting of an amide group, an ester group, an amino group, and a carboxyl group, a ratio R1 of the low-melting-point lubricant to whole of the (b) lubricant is 5 mass % or more and less than 90 mass %, a ratio R2 of a mass of a (b2) free lubricant to a mass of a (b1) binding lubricant is 0 or more and 15 or less, where the (b1) binding lubricant is the (b) lubricant adhering to a surface of the (a) iron-based powder, and the (b2) free lubricant is the (b) lubricant not adhering to the surface of the (a) iron-based powder, and an amount R3 of the low-melting-point lubricant contained as the (b2) free lubricant is less than 0.10 parts by mass with respect to 100 parts by mass of the iron-based powder.
3. The mixed powder for powder metallurgy according to 1. or 2., wherein the (b1) binding lubricant and the (b2) free lubricant contain a fatty acid derivative having at least one of an alkyl group having a carbon number of 11 or more and an alkenyl group having a carbon number of 11 or more.
4. The mixed powder for powder metallurgy according to any one of 1. to 3., wherein a lubricant having a melting point of 100° C. or more is contained as the high-melting-point lubricant, and a ratio R4 of the lubricant having a melting point of 100° C. or more to the whole of the (b) lubricant is 10 mass % or more.
5. The mixed powder for powder metallurgy according to any one of 1. to 4., wherein the high-melting-point lubricant is at least one selected from the group consisting of a fatty acid amide, a fatty acid metal soap, and a mixture thereof.
6. The mixed powder for powder metallurgy according to any one of 1. to 5., wherein the low-melting-point lubricant is a monoamide having a fatty chain containing an unsaturated bond.
7. The mixed powder for powder metallurgy according to any one of 1. to 6., further comprising one or both of an (e) alloying powder and a (f) machinability improver.
8. The mixed powder for powder metallurgy according to 7., wherein one or both of the (e) alloying powder and the (f) machinability improver are adhered to the surface of the (a) iron-based powder via the (b1) binding lubricant.

We also provide the following.

A mixed powder for powder metallurgy, comprising: an (a) iron-based powder; and a (b) lubricant, and further comprising at least one of (c) carbon black and a (d) carbonate in the case where the (b) lubricant does not contain a fatty acid metal soap, wherein the (b) lubricant consists of a low-melting-point lubricant having a melting point of 86° C. or less and a high-melting-point lubricant having a melting point of more than 86° C., the low-melting-point lubricant has at least one selected from the group consisting of an amide group, an ester group, an amino group, and a carboxyl group, a ratio R1 of the low-melting-point lubricant to whole of the (b) lubricant is 5 mass % or more and less than 90 mass %, a ratio R2 of a mass of a (b2) free lubricant to a mass of a (b1) binding lubricant is 0 or more and 15 or less, where the (b1) binding lubricant is the (b) lubricant adhering to a surface of the (a) iron-based powder, and the (b2) free lubricant is the (b) lubricant not adhering to the surface of the (a) iron-based powder, and an amount R3 of the low-melting-point lubricant contained as the (b2) free lubricant is less than 0.10 parts by mass with respect to 100 parts by mass of the iron-based powder.

We also provide the following.

1. A mixed powder for powder metallurgy, comprising: an (a) iron-based powder; and a (b) lubricant, wherein the (b) lubricant contains a fatty acid metal soap, the (b) lubricant consists of a low-melting-point lubricant having a melting point of 86° C. or less and a high-melting-point lubricant having a melting point of more than 86° C., the low-melting-point lubricant has at least one selected from the group consisting of an amide group, an ester group, an amino group, and a carboxyl group, a ratio R1 of the low-melting-point lubricant to whole of the (b) lubricant is 5 mass % or more and less than 90 mass %, the (b) lubricant consists of a (b1) binding lubricant adhering to a surface of the (a) iron-based powder and a (b2) free lubricant not adhering to the surface of the (a) iron-based powder, a ratio R2 of a mass of the (b1) binding lubricant to a mass of the (b2) free lubricant is 0.10 to 9.0, and an amount R3 of the low-melting-point lubricant contained as the (b2) free lubricant is less than 0.10 parts by mass with respect to 100 parts by mass of the iron-based powder.
2. A mixed powder for powder metallurgy, comprising: an (a) iron-based powder; a (b) lubricant; and at least one of (c) carbon black and a (d) carbonate, wherein the (b) lubricant does not contain a fatty acid metal soap, the (b) lubricant consists of a low-melting-point lubricant having a melting point of 86° C. or less and a high-melting-point lubricant having a melting point of more than 86° C., the low-melting-point lubricant has at least one selected from the group consisting of an amide group, an ester group, an amino group, and a carboxyl group, a ratio R1 of the low-melting-point lubricant to whole of the (b) lubricant is 5 mass % or more and less than 90 mass %, the (b) lubricant consists of a (b1) binding lubricant adhering to a surface of the (a) iron-based powder and a (b2) free lubricant not adhering to the surface of the (a) iron-based powder, a ratio R2 of a mass of the (b1) binding lubricant to a mass of the (b2) free lubricant is 0.10 to 9.0, and an amount R3 of the low-melting-point lubricant contained as the (b2) free lubricant is less than 0.10 parts by mass with respect to 100 parts by mass of the iron-based powder.
3. The mixed powder for powder metallurgy according to 1. or 2., wherein the (b1) binding lubricant and the (b2) free lubricant contain a fatty acid derivative having at least one of an alkyl group having a carbon number of 11 or more and an alkenyl group having a carbon number of 11 or more.
4. The mixed powder for powder metallurgy according to any one of 1. to 3., wherein a lubricant having a melting point of 100° C. or more is contained as the high-melting-point lubricant, and a ratio R4 of the lubricant having a melting point of 100° C. or more to the whole of the (b) lubricant is 10 mass % or more.
5. The mixed powder for powder metallurgy according to any one of 1. to 4., wherein the high-melting-point lubricant is at least one selected from the group consisting of a fatty acid amide, a fatty acid metal soap, and a mixture thereof.
6. The mixed powder for powder metallurgy according to any one of 1. to 5., wherein the low-melting-point lubricant is a monoamide having a fatty chain containing an unsaturated bond.
7. The mixed powder for powder metallurgy according to any one of 1. to 6., further comprising one or both of an (e) alloying powder and a (f) machinability improver.
8. The mixed powder for powder metallurgy according to 7., wherein one or both of the (e) alloying powder and the (f) machinability improver are adhered to the surface of the (a) iron-based powder via the (b1) binding lubricant.

We also provide the following.

A mixed powder for powder metallurgy, comprising: an (a) iron-based powder; and a (b) lubricant, and further comprising at least one of (c) carbon black and a (d) carbonate in the case where the (b) lubricant does not contain a fatty acid metal soap, wherein the (b) lubricant consists of a low-melting-point lubricant having a melting point of 86° C. or less and a high-melting-point lubricant having a melting point of more than 86° C., the low-melting-point lubricant has at least one selected from the group consisting of an amide group, an ester group, an amino group, and a carboxyl group, a ratio R1 of the low-melting-point lubricant to whole of the (b) lubricant is 5 mass % or more and less than 90 mass %, the (b) lubricant consists of a (b1) binding lubricant adhering to a surface of the (a) iron-based powder and a (b2) free lubricant not adhering to the surface of the (a) iron-based powder, a ratio R2 of a mass of the (b1) binding lubricant to a mass of the (b2) free lubricant is 0.10 to 9.0, and an amount R3 of the low-melting-point lubricant contained as the (b2) free lubricant is less than 0.10 parts by mass with respect to 100 parts by mass of the iron-based powder.

Advantageous Effect

It is thus possible to provide a mixed powder for powder metallurgy that combines excellent fluidity and excellent ejection properties and compressibility during compaction. As a lubricant contained in the mixed powder for powder metallurgy, a lubricant readily available commercially can be used with no need for a special production process. In the case where the mixed powder for powder metallurgy further contains at least one of carbon black and a carbonate, favorable fluidity, ejection properties, and compressibility can be achieved without adding a metal soap that causes stains in a furnace during sintering.

DETAILED DESCRIPTION

One of the disclosed embodiments will be described in detail below. In the following description, "%" denotes "mass %" unless otherwise noted.

A mixed powder for powder metallurgy according to one of the disclosed embodiments contains the following (a) and (b) as essential components. In the case where the (b) lubricant does not contain a metal soap, the mixed powder for powder metallurgy contains at least one of (c) and (d) as an essential component. In other words, the mixed powder for powder metallurgy according to one of the disclosed embodiments is a mixed powder for powder metallurgy comprising: an (a) iron-based powder; and a (b) lubricant, and further comprising at least one of (c) carbon black and a (d) carbonate in the case where the (b) lubricant does not contain a fatty acid metal soap. A mixed powder for powder metallurgy according to another one of the disclosed embodiments may optionally further comprise at least one of the following (e) and (f), in addition to the foregoing components. Each of these components will be described below.

(a) Iron-based powder
(b) Lubricant
(c) Carbon black
(d) Carbonate
(e) Alloying powder
(f) Machinability improver (a) Iron-Based Powder The iron-based powder is not limited, and may be any iron-based powder. Examples of the iron-based powder include an iron powder and an alloyed steel powder. As the alloyed steel powder, for example, at least one selected from the group consisting of a pre-alloyed steel powder, a partially diffusion-alloyed steel powder, and a hybrid steel powder is preferably used. The pre-alloyed steel powder is an alloyed steel powder obtained by pre-alloying an alloying element during smelting, and is also referred to as a fully alloyed steel powder. The partially diffusion-alloyed steel powder is a powder that is composed of an iron powder as a core and particles of at least one alloying element adhering to the surface of the iron powder and in which the iron powder and the alloying element particles are diffusionally bonded. The hybrid steel powder is a powder obtained by further diffusionally adhering alloying element particles to the surface of the pre-alloyed steel powder. The alloying element may be, for example, one or more selected from the group consisting of C, Cu, Ni, Mo, Mn, Cr, V, and Si.

As used herein, the "iron-based powder" denotes a metal powder containing 50% or more of Fe. The "iron powder" denotes a powder consisting of Fe and inevitable impurities and is commonly referred to as "pure iron powder" in this technical field.

The iron-based powder may be produced by any method. For example, the iron-based powder may be a reduced iron-based powder, an atomized iron-based powder, or a mixture thereof. The reduced iron-based powder is an iron-based powder produced by reducing iron oxide. The atomized iron-based powder is an iron-based powder produced by an atomizing method. A powder produced by diffusionally adhering an alloying element to the surface of the reduced iron-based powder or the atomized iron-based powder may also be used as the iron-based powder.

The iron-based powder may be of any size, but an iron-based powder having a median size D50 of 30 μm to 120 μm is preferable.

The ratio of the mass of the iron-based powder to the total mass of the mixed powder for powder metallurgy is not limited, but is preferably 86 mass % or more, and more preferably 90 mass % or more.

(b) Lubricant

The lubricant used in the present disclosure consists of a low-melting-point lubricant having a melting point of 86° C. or less and a high-melting-point lubricant having a melting point of more than 86° C. Each of the low-melting-point lubricant and the high-melting-point lubricant will be described below.

Low-Melting-Point Lubricant

The lubricant used in the present disclosure contains a lubricant having a melting point of 86° C. or less (hereafter referred to as "low-melting-point lubricant"), as an essential component. As a result of the low-melting-point lubricant being added, the ejection force when ejecting the green compact from the die can be reduced.

As the low-melting-point lubricant, a lubricant having at least one selected from the group consisting of an amide group, an ester group, an amino group, and a carboxyl group is used. The low-melting-point lubricant is preferably a fatty acid derivative, and more preferably a fatty acid derivative having at least one of an alkyl group having a carbon number of 11 or more and an alkenyl group having a carbon number of 11 or more. Although no upper limit is placed on the carbon number, the carbon number is preferably 30 or less and more preferably 22 or less from the viewpoint of availability.

More specifically, the low-melting-point lubricant is preferably at least one selected from the group consisting of fatty acid monoamides, fatty acid esters, aliphatic amines, and fatty acids.

Examples of the fatty acid monoamides include oleamide and erucamide. Examples of the fatty acid esters include an ester of an aliphatic alcohol and a fatty acid, a sucrose fatty acid ester, and a glycerin fatty acid ester. Examples of the aliphatic amines include stearylamine and behenylamine. Examples of the fatty acids include stearic acid and behenic acid. Examples of the fatty acids include stearic acid, behenic acid, and lauric acid.

The low-melting-point lubricant is more preferably a monoamide having a fatty chain containing an unsaturated bond, for the following reason. Of the functional groups listed above, the amide group is a functional group that particularly interacts greatly with a die. Accordingly, a fatty acid monoamide is expected to exhibit high lubricity during compaction using a die. However, the fatty acid monoamide typically has a high melting point, and thus has the drawback that it does not easily seep into the gap between the die and the green compact during the compaction. On the other hand, a monoamide having a fatty chain containing an unsaturated bond has a low melting point because it contains the unsaturated bond, and therefore can exhibit very high lubricity. Examples of the monoamide having a fatty acid containing an unsaturated bond include oleamide and erucamide.

No lower limit is placed on the melting point of the low-melting-point lubricant. However, when compacting a mixed powder using a die, the die temperature increases due to frictional heat and the ejection properties are adversely affected in some cases. Hence, from the viewpoint of achieving excellent ejection properties not only at around normal temperature but also in the case where the die temperature increases, the melting point of the low-melting-point lubricant is preferably 45° C. or more, more preferably 50° C. or more, and further preferably 55° C. or more.

In industrial production, thousands or tens of thousands of parts are compacted successively, so that the die temperature may reach a high temperature of 75° C. to 80° C. From the viewpoint of achieving excellent ejection properties even in the case where the die temperature reaches high temperature in mass production, the melting point of the low-melting-point lubricant is preferably 75° C. or more. From this viewpoint, it is particularly preferable to use, as the low-melting-point lubricant, at least one of a fatty acid monoamide having a melting point of 80° C. or more and a fatty acid having a melting point of 75° C. or more.

R1:5% or More and Less than 90%

As mentioned above, the low-melting-point lubricant has the effect of reducing the ejection force when ejecting the green compact from the die. To achieve this effect, the ratio R1 of the low-melting-point lubricant to the whole of the (b) lubricant needs to be 5% or more. Accordingly, R1 is 5% or more, and preferably 10% or more. If the ratio of the low-melting-point lubricant is excessive, the fluidity of the mixed powder decreases. Accordingly, R1 is less than 90%, preferably 85% or less, and more preferably 80% or less. In order to achieve both the fluidity of the mixed powder and the ejection properties of the green compact, it is important to limit R1 to 5% or more and less than 90%. R1 can be calculated according to the following formula:

$$R1(\text{mass }\%)=(\text{the mass of the low-melting-point lubricant})/(\text{the total mass of the lubricant})\times 100.$$

At least part of the lubricant adheres to the surface of the (a) iron-based powder, and the rest of the lubricant does not adhere to the surface of the iron-based powder. The lubricant adhering to the surface of the iron-based powder is defined as a (b1) binding lubricant, and the lubricant not adhering to the surface of the iron-based powder is defined as a (b2) free lubricant. The free lubricant need not necessarily be included. In other words, the whole lubricant may be the binding lubricant. In the case where the free lubricant is present, the lubricant consists of the (b1) binding lubricant adhering to the surface of the iron-based powder and the (b2) free lubricant not adhering to the surface of the iron-based powder. Preferably, at least part of the low-melting-point lubricant directly adheres (binds) to the surface of the iron-based powder. The whole low-melting-point lubricant may directly adhere (bind) to the surface of the iron-based powder.

R2:0 to 15

The ratio R2 of the mass of the (b2) free lubricant to the mass of the (b1) binding lubricant is 0 or more and 15 or less. Since the mixed powder for powder metallurgy according to the present disclosure may not contain the free lubricant, R2 may be 0. If R2 is more than 15, the fluidity of the mixed powder for powder metallurgy degrades. R2 is therefore 15 or less, and preferably 10.0 or less. R2 can be calculated according to the following formula:

$$R2=(\text{the mass of the free lubricant})/(\text{the mass of the binding lubricant}).$$

From the viewpoint of further improving the ejection properties, the ratio R5 of the mass of the (b1) binding lubricant to the mass of the (b2) free lubricant is preferably 0.10 to 9.0. R5 is more preferably 0.15 or more. R5 is more preferably 7.0 or less, and further preferably 6.0 or less. R5 is the inverse of R2, and can be calculated according to the following formula:

$$R5=1/R2=(\text{the mass of the binding lubricant})/(\text{the mass of the free lubricant}).$$

R3: Less than 0.10 Parts by Mass

As mentioned above, the low-melting-point lubricant has the effect of reducing the ejection force when ejecting the green compact from the die. In the case where the low-melting-point lubricant exists as the free lubricant, however, the low-melting-point lubricant decreases the fluidity of the mixed powder. By causing most of the low-melting-point lubricant to exist as the binding lubricant, the decrease in the fluidity can be prevented. Accordingly, the amount R3 of the low-melting-point lubricant contained as the (b2) free lubricant is less than 0.10 parts by mass with respect to 100 parts by mass of the iron-based powder. Lower R3 is more preferable, and thus no lower limit is placed on R3. R3 may be 0 part by mass.

The mixed powder according to the present disclosure may optionally further contain one or both of an (e) alloying powder and a (f) machinability improver. In this case, the (b1) binding lubricant can be used as a binder for adhering the additive components such as the alloying powder and the machinability improver to the surface of the iron-based powder. As a result of the additive components being adhered to the surface of the iron-based powder via the binding lubricant, segregation of the additive components in the mixed powder can be prevented. The binding lubricant serves as both a lubricant and a binder in this case.

High-Melting-Point Lubricant

The lubricant used in the present disclosure contains a lubricant having a melting point of 86° C. or less (low-melting-point lubricant), with the balance being a lubricant having a melting point of more than 86° C. (hereafter referred to as "high-melting-point lubricant"). That is, the lubricant consists of a low-melting-point lubricant having a melting point of 86° C. or less and a high-melting-point lubricant having a melting point of more than 86° C. The use of the high-melting-point lubricant in addition to the low-melting-point lubricant can improve the fluidity of the mixed powder.

The high-melting-point lubricant may be any lubricant. The high-melting-point lubricant is preferably a fatty acid derivative, and more preferably a fatty acid derivative having at least one of an alkyl group having a carbon number of 11 or more and an alkenyl group having a carbon number of 11 or more. No upper limit is placed on the carbon number, but the carbon number is preferably 30 or less and more preferably 22 or less from the viewpoint of availability.

The high-melting-point lubricant is preferably a fatty acid amide, a fatty acid metal soap, or a mixture thereof. As the fatty acid amide, any of a fatty acid monoamide and a fatty acid bisamide may be used.

Examples of the fatty acid monoamide include stearamide and behenamide. Examples of the fatty acid bisamide include N,N'-ethylenebisstearamide and N,N'-ethylenebisoleamide. Examples of the fatty acid metal soap include zinc stearate, lithium stearate, calcium stearate, magnesium stearate, barium stearate, and aluminum stearate.

The high-melting-point lubricant preferably contains a lubricant having a melting point of 100° C. or more, from the viewpoint of further improving the fluidity of the mixed powder for powder metallurgy.

R4:10% or More

In the case of using a lubricant having a melting point of 100° C. or more, the ratio R4 of the lubricant having a melting point of 100° C. or more to the whole lubricant is preferably 10% or more, in order to further enhance the fluidity improving effect.

Although no upper limit is placed on the melting point of the high-melting-point lubricant, a high-melting-point lubricant having a melting point of 250° C. or less is preferable and a high-melting-point lubricant having a melting point of 230° C. or less is more preferable from the viewpoint of availability.

In the case where the lubricant contains a fatty acid metal soap, the high-melting-point lubricant may consist only of the fatty acid metal soap, but preferably further contains one or more high-melting-point lubricants other than the fatty acid metal soap, and more preferably contains two or more high-melting-point lubricants other than the fatty acid metal soap. In particular, the high-melting-point lubricant preferably contains a fatty acid metal soap having a melting point of more than 86° C. as a first high-melting-point lubricant, a high-melting-point lubricant having a melting point of more than 86° C. and 100° C. or less other than a fatty acid metal soap as a second high-melting-point lubricant, and a high-melting-point lubricant having a melting point of more than 100° C. as a third high-melting-point lubricant. This is because the use of a plurality of high-melting-point lubricants that differ in melting point can contribute to better balance between the ejection properties and the powder fluidity.

In the case where the lubricant does not contain a fatty acid metal soap, the high-melting-point lubricant may consist only of one lubricant, but preferably contains two or more lubricants. For example, the high-melting-point lubricant preferably contains a high-melting-point lubricant having a melting point of more than 86° C. and 110° C. or less as a first high-melting-point lubricant and a high-melting-point lubricant having a melting point of more than 110° C. as a second high-melting-point lubricant. This is because the use of a plurality of high-melting-point lubricants that differ in melting point can contribute to better balance between the ejection properties and the powder fluidity.

Fatty Acid Metal Soap

The lubricant may optionally contain a fatty acid metal soap as a high-melting-point lubricant, as mentioned above., That is, the lubricant may or may not contain a fatty acid metal soap. From the viewpoint of achieving both the fluidity of the mixed powder and the ejection properties, the lubricant preferably contains a fatty acid metal soap. The metal soap is preferably contained not as a binding lubricant but as a free lubricant. However, in the case where the mixed powder contains a fatty acid zinc soap, when compacting and sintering the mixed powder, metal oxide forms and stains the surface of the furnace or the green compact. Hence, the lubricant preferably does not contain a fatty acid metal soap from the viewpoint of preventing stains.

(c) Carbon Black and (d) Carbonate

The mixed powder according to one of the disclosed embodiments may optionally contain at least one of carbon black and a carbonate. Carbon black and a carbonate are each a component having the effect of improving the fluidity of the mixed powder. Accordingly, the mixed powder preferably contains at least one of carbon black and a carbonate from the viewpoint of improving the fluidity of the mixed powder.

A fatty acid metal soap also has the effect of improving the fluidity of the mixed powder. Therefore, in the case where the mixed powder contains a fatty acid metal soap, carbon black and/or a carbonate need not necessarily be added. In the case where the mixed powder does not contain a fatty acid metal soap, on the other hand, the mixed powder needs to contain at least one of carbon black and a carbonate in order to ensure the fluidity. In other words, the mixed powder according to the present disclosure contains at least one of a fatty acid metal soap, carbon black, and a carbonate.

(c) Carbon Black

In the case of using the carbon black, the amount of the carbon black added is preferably 0.01 parts by mass to 3.0 parts by mass with respect to 100 parts by mass of the iron-based powder. If the amount of the carbon black added is 0.01 parts by mass or more, the fluidity improving effect can be further enhanced. If the amount of the carbon black added is 3.0 parts by mass or less, decreases in compressibility and ejection properties can be prevented and higher compressibility and ejection properties can be ensured.

(d) Carbonate

As the carbonate, any carbonate may be used. From the viewpoint of availability and the like, the carbonate is preferably a metal carbonate, and is preferably at least one selected from the group consisting of an alkali metal carbonate and an alkaline earth metal carbonate. More specifically, the carbonate is preferably at least one selected from the group consisting of calcium carbonate, lithium carbonate, sodium carbonate, potassium carbonate, and magnesium carbonate.

In the case of using the carbonate, the amount of the carbonate added is preferably 0.05 parts by mass to 1.0 part by mass with respect to 100 parts by mass of the iron-based powder. If the amount of the carbonate added is 0.05 parts by mass or more, the fluidity improving effect can be further enhanced. If the amount of the carbonate added is 1.0 part by mass or less, decreases in compressibility and ejection properties can be prevented and higher compressibility and ejection properties can be ensured.

If the specific surface area of the carbonate is 3 $m^2/g$ or more, the fluidity of the mixed powder can be further improved. The specific surface area of the carbonate is therefore preferably 3 $m^2/g$ or more.

The mixed powder according to one of the disclosed embodiments may optionally further contain one or both of the (e) alloying powder and the (f) machinability improver.

(e) Alloying Powder

When a mixed powder containing an alloying powder is sintered, an alloying element dissolves in iron and alloys. Therefore, using an alloying powder can improve the strength of a final sintered body. Thus, the alloying powder is preferably added from the viewpoint of improving the strength of the sintered body.

The alloying powder is not limited and may be any powder that can be an alloying component. For example, the alloying powder may be at least one powder selected from the group consisting of C, Cu, Ni, Mo, Mn, Cr, V, and Si. When C is used as the alloying component, the alloying powder is preferably graphite powder.

(f) Machinability Improver

Adding the machinability improver can improve the machinability (workability) of a final sintered body. Thus, the machinability improver is preferably added from the viewpoint of improving the machinability of the sintered body.

For example, the machinability improver may be at least one selected from the group consisting of MnS, $CaF_2$, and talc.

The amount of the (e) alloying powder and the (f) machinability improver added is not limited and may be any amount. The total amount of the (e) alloying powder and the (f) machinability improver is preferably 10 parts by mass or less, more preferably 7 parts by mass or less, and further preferably 5 parts by mass or less with respect to 100 parts by mass of the iron-based powder. When the total amount of the (e) alloying powder and the (f) machinability improver is within such range, the density of the sintered body can be further increased, and the strength of the sintered body can be further improved. On the other hand, since the (e) alloying powder and the (f) machinability improver do not necessarily have to be contained, the lower limit of the total amount with respect to 100 parts by mass of the iron-based powder may be 0 parts by mass. However, when the (e) alloying powder and the (f) machinability improver are contained, the total amount is preferably 0.1 parts by mass or more, more preferably 0.5 parts by mass or more, and further preferably 1 part by mass or more. When the total amount of the (e) alloying powder and the (f) machinability improver is within such range, the effect of adding these components can be further enhanced.

[Production Method for Mixed Powder]

The method of producing the mixed powder according to the present disclosure is not limited, and may be any method. In one of the disclosed embodiments, the above-described components may be mixed using a mixer to obtain a mixed powder for powder metallurgy. The addition and mixing of the components may be performed once, or performed two or more times separately.

For example, one way of adhering the lubricant to the surface of the iron-based powder to serve as the binding lubricant is to stir the components while heating them to the melting point of the lubricant or higher during the mixing, and then gradually cool them while mixing. As a result, the surface of the iron-based powder is coated with the melted lubricant. In the case of using the alloying powder and the machinability improver, the alloying powder and the machinability improver are preferably added simultaneously with the lubricant used as the binding lubricant. In this way, components such as the alloying powder and the machinability improver are adhered to the surface of the iron-based powder via the binding lubricant adhering to the surface of the iron-based powder. After mixing the iron-based powder and the low-melting-point lubricant, the mixture may be heated to a temperature higher than the melting point of the low-melting-point lubricant, to adhere (bind) at least part of the low-melting-point lubricant to the surface of the iron-based powder.

The free lubricant may be separately added and mixed, after adhering the binding lubricant to the surface of the iron-based powder. The addition and mixing of the free lubricant are performed at a temperature lower than the melting point of the binding lubricant so that the already adhered binding lubricant will not melt.

In the case of using the carbon black and the carbonate, they may be added simultaneously with or separately from the free lubricant.

The mixing means is not limited, and any mixing means may be used. From the viewpoint of easy heating, it is preferable to use at least one selected from the group consisting of a high-speed bottom stirring mixer, an inclined rotating pan-type mixer, a rotating hoe-type mixer, and a conical planetary screw-type mixer.

EXAMPLES

First Example

Mixed powders for powder metallurgy were prepared by the following procedure. The properties of each obtained mixed powder for powder metallurgy and the properties of a green compact prepared using the mixed powder for powder metallurgy were evaluated.

First, a lubricant used as a (b1) binding lubricant and an (e) alloying powder were added to an (a) iron-based powder. Following this, these components were heated and mixed at a temperature higher than the melting point of the whole lubricant added, and then cooled to a temperature lower than the melting point of the whole lubricant. After this, a (b2) free lubricant, (c) carbon black, and a (d) carbonate were added, and mixed at room temperature.

An iron powder (pure iron powder) (JIP301A produced by JFE Steel Corporation) prepared with an atomizing method was used as the (a) iron-based powder. The median size D50 of the iron powder was 80 μm. Copper powder and graphite powder were used as the (e) alloying powder. The median size D50 of the copper powder was 25 μm, and the median size of the graphite powder was 4.2 μm. The median size D50 was measured by a laser diffraction particle size distribution measuring device.

The types and melting points of the lubricants used are shown in Table 1. Of the lubricants shown in Table 1, P to U are fatty acid metal soaps. The respective addition amounts of the components in each mixed powder are shown in Tables 2 and 3.

For each obtained mixed powder for powder metallurgy, the apparent density, the fluidity, the ejection force during compaction, and the density of the green compact were evaluated by the following procedures. The measurement results are shown in Tables 4 and 5.

(Apparent Density)

The apparent density was evaluated using a funnel having an orifice of 2.5 mm in diameter, according to a method defined in JIS Z 2504. Specifically, the mixed powder was poured into a container of a known volume using the funnel having an orifice of 2.5 mm in diameter to naturally charge the mixed powder, and then the mass was measured. The apparent density of the mixed powder was calculated from the measured mass and the volume of the container.

(Fluidity)

The fluidity of the powder was evaluated according to a method defined in JIS Z 2502. Specifically, using a funnel having an orifice of 2.5 mm in diameter, the time until 50 g of the mixed powder flowed down from the orifice was measured, and used as an index of the fluidity. In the case where the mixed powder did not flow down due to excessively low fluidity, "not flow" is indicated in Tables 4 and 5.

(Ejection Force)

Using the mixed powder for powder metallurgy, a cylindrical green compact with a diameter of 11.3 mm and a height of 10 mm was produced at a compaction pressure of 686 MPa according to a method defined in JPMA P 13. The maximum load when ejecting the green compact from the die was taken to be the ejection force. A lower ejection force corresponds to better ejection properties.

(Density of the Green Compact)

The density of the green compact was measured according to a method defined in JIS Z 2508. The density was calculated from the dimensions and weight of the obtained green compact. A higher density corresponds to better compressibility.

As can be seen from the results shown in Tables 4 and 5, each of the mixed powders of the examples satisfying the conditions according to the present disclosure combined all of the fluidity of the mixed powder, the ejection properties during compaction, and the compressibility of the green compact. On the other hand, each of the mixed powders of the comparative examples not satisfying the conditions according to the present disclosure was inferior in at least one of the fluidity of the mixed powder, the ejection properties during compaction, and the density of the green compact.

TABLE 1

| ID | Lubricant | Melting point (° C.) | Carbon number: Alkyl group | Carbon number: Alkenyl group |
|---|---|---|---|---|
| A | Erucamide | 80 | — | 21 |
| B | Oleamide | 76 | — | 17 |
| C | Stearic acid | 70 | 17 | — |
| D | Behenic acid | 76 | 21 | — |
| E | Behenylamine | 55 to 65 | 22 | — |
| F | Behenyl behenate | 70 | 21, 22 | — |
| G | Pentaerythritol tetrastearate | 60 to 65 | 17 | — |
| H | Pentaerythritol tetrastearate tetrabehenate | 81 to 86 | 21 | — |
| I | Monostearic acid glycerin ester | 56 to 77 | 17 | — |
| J | Monobehenic acid glycerin ester | 76 | 21 | — |

TABLE 1-continued

| ID | Lubricant | Melting point (° C.) | Carbon number: Alkyl group | Carbon number: Alkenyl group |
|---|---|---|---|---|
| K | Sucrose behenic acid ester | 63 | 21 | — |
| L | Sucrose stearic acid ester | 58 | 17 | — |
| M | Sucrose lauric acid ester | 47 | 11 | — |
| N | EBS (ethylenebisstearamide) | 145 | 17 | — |
| O | Stearamide | 102 | 17 | — |
| P | Zinc stearate | 125 | 17 | — |
| Q | Lithium stearate | 220 | 17 | — |

TABLE 1-continued

| ID | Lubricant | Melting point (° C.) | Carbon number: Alkyl group | Carbon number: Alkenyl group |
|---|---|---|---|---|
| R | Calcium stearate | 147 to 149 | 17 | — |
| S | Magnesium stearate | 200 | 17 | — |
| T | Barium stearate | >225° C. | 17 | — |
| U | Aluminum stearate | 110 to 130° C. | 17 | — |

TABLE 2

| | (a) | (e) | | (b) Lubricant | | | | | | | |
|---|---|---|---|---|---|---|---|---|---|---|---|
| | | | | (b1) Binding lubricant | | | | | | (b2) Free lubricant | |
| | | | | Lubricant 1 | | Lubricant 2 | | Lubricant 3 | | Lubricant 4 | |
| | Iron-based | Alloying powder | | | Addition | | Addition | | Addition | | Addition |
| No. | powder (parts by mass) | Copper* (parts by mass) | Graphite* (parts by mass) | Type | amount* (parts by mass) | Type | amount* (parts by mass) | Type | amount* (parts by mass) | Type | amount* (parts by mass) |
| 1 | 100 | 2.0 | 0.8 | A | 0.40 | — | — | — | — | N | 0.20 |
| 2 | 100 | 2.0 | 0.8 | B | 0.40 | — | — | — | — | N | 0.20 |
| 3 | 100 | 2.0 | 0.8 | C | 0.40 | — | — | — | — | N | 0.20 |
| 4 | 100 | 2.0 | 0.8 | D | 0.40 | — | — | — | — | N | 0.20 |
| 5 | 100 | 2.0 | 0.8 | E | 0.40 | — | — | — | — | N | 0.20 |
| 6 | 100 | 2.0 | 0.8 | F | 0.40 | — | — | — | — | N | 0.20 |
| 7 | 100 | 2.0 | 0.8 | G | 0.40 | — | — | — | — | N | 0.20 |
| 8 | 100 | 2.0 | 0.8 | H | 0.40 | — | — | — | — | N | 0.20 |
| 9 | 100 | 2.0 | 0.8 | U | 0.40 | — | — | — | — | N | 0.20 |
| 10 | 100 | 2.0 | 0.8 | J | 0.40 | — | — | — | — | N | 0.20 |
| 11 | 100 | 2.0 | 0.8 | K | 0.40 | — | — | — | — | N | 0.20 |
| 12 | 100 | 2.0 | 0.8 | L | 0.40 | — | — | — | — | N | 0.20 |
| 13 | 100 | 2.0 | 0.8 | M | 0.40 | — | — | — | — | N | 0.20 |
| 14 | 100 | 2.0 | 0.8 | A | 0.10 | — | — | — | — | N | 0.50 |
| 15 | 100 | 2.0 | 0.8 | A | 0.10 | O | 0.25 | N | 0.25 | P | 0.20 |
| 16 | 100 | 2.0 | 0.8 | A | 0.10 | O | 0.05 | N | 0.05 | O | 0.30 |
| 17 | 100 | 2.0 | 0.8 | A | 0.10 | O | 0.05 | N | 0.05 | O | 0.30 |
| 18 | 100 | 2.0 | 0.8 | A | 0.10 | O | 0.05 | N | 0.05 | O | 0.30 |
| 19 | 100 | 2.0 | 0.8 | A | 0.10 | O | 0.05 | N | 0.05 | O | 0.30 |
| 20 | 100 | 2.0 | 0.8 | A | 0.10 | O | 0.05 | N | 0.05 | O | 0.30 |
| 21 | 100 | 2.0 | 0.8 | A | 0.10 | O | 0.05 | N | 0.05 | O | 0.30 |
| 22 | 100 | 2.0 | 0.8 | A | 0.07 | — | — | — | — | O | 0.40 |

| | (b) Lubricant | | | | | | | | (c) | (d) | | |
|---|---|---|---|---|---|---|---|---|---|---|---|---|
| | (b2) Free lubricant | | | | | | | | Carbon | | | |
| | Lubricant 5 | | Lubricant 6 | | | | | | black | Carbonate | | |
| No. | Type | Addition amount* (parts by mass) | Type | Addition amount* (parts by mass) | R1 (%) | R2 (—) | R3* (parts by mass) | R4 (%) | Addition amount* (parts by mass) | Type | Addition amount* (parts by mass) | Remarks |
| 1 | P | 0.20 | — | — | 50 | 1.0 | 0 | 50 | — | — | — | Example |
| 2 | P | 0.20 | — | — | 50 | 1.0 | 0 | 50 | — | — | — | Example |
| 3 | P | 0.20 | — | — | 50 | 1.0 | 0 | 50 | — | — | — | Example |
| 4 | P | 0.20 | — | — | 50 | 1.0 | 0 | 50 | — | — | — | Example |
| 5 | P | 0.20 | — | — | 50 | 1.0 | 0 | 50 | — | — | — | Example |
| 6 | P | 0.20 | — | — | 50 | 1.0 | 0 | 50 | — | — | — | Example |
| 7 | P | 0.20 | — | — | 50 | 1.0 | 0 | 50 | — | — | — | Example |
| 8 | P | 0.20 | — | — | 50 | 1.0 | 0 | 50 | — | — | — | Example |
| 9 | P | 0.20 | — | — | 50 | 1.0 | 0 | 50 | — | — | — | Example |
| 10 | P | 0.20 | — | — | 50 | 1.0 | 0 | 50 | — | — | — | Example |
| 11 | P | 0.20 | — | — | 50 | 1.0 | 0 | 50 | — | — | — | Example |
| 12 | P | 0.20 | — | — | 50 | 1.0 | 0 | 50 | — | — | — | Example |
| 13 | P | 0.20 | — | — | 50 | 1.0 | 0 | 50 | — | — | — | Example |
| 14 | P | 0.20 | — | — | 13 | 7.0 | 0 | 88 | — | — | — | Example |
| 15 | — | — | — | — | 13 | 0.3 | 0 | 88 | — | — | — | Example |
| 16 | N | 0.30 | P | 0.10 | 11 | 3.5 | 0 | 89 | — | — | — | Example |
| 17 | N | 0.30 | Q | 0.10 | 11 | 3.5 | 0 | 89 | — | — | — | Example |

TABLE 2-continued

| | | | | | | | | | | | | |
|---|---|---|---|---|---|---|---|---|---|---|---|---|
| 18 | N | 0.30 | R | 0.10 | 11 | 3.5 | 0 | 89 | — | — | — | Example |
| 19 | N | 0.30 | S | 0.10 | 11 | 3.5 | 0 | 89 | — | — | — | Example |
| 20 | N | 0.30 | T | 0.10 | 11 | 3.5 | 0 | 89 | — | — | — | Example |
| 21 | N | 0.30 | U | 0.10 | 11 | 3.5 | 0 | 89 | — | — | — | Example |
| 22 | N | 0.40 | Q | 0.10 | 8 | 13 | 0 | 92 | — | — | — | Example |

*Amount with respect to 100 parts by mass of iron-based powder.

TABLE 3

| | | | | (b) Lubricant | | | | | | | | |
|---|---|---|---|---|---|---|---|---|---|---|---|---|
| | | | | (b1) Binding lubricant | | | | | | (b2) Free lubricant | | |
| | (a) | (e) | | Lubricant 1 | | Lubricant 2 | | Lubricant 3 | | Lubricant 4 | | |
| | Iron-based | Alloying powder | | | Addition | | Addition | | Addition | | Addition | |
| No. | powder (parts by mass) | Copper* (parts by mass) | Graphite* (parts by mass) | Type | amount* (parts by mass) | Type | amount* (parts by mass) | Type | amount* (parts by mass) | Type | amount* (parts by mass) | Lubricant 5 Type |
| 23 | 100 | 2.0 | 0.8 | A | 0.04 | — | — | — | — | N | 0.56 | P |
| 24 | 100 | 2.0 | 0.8 | N | 0.40 | — | — | — | — | N | 0.20 | P |
| 25 | 100 | 2.0 | 0.8 | A | 0.48 | — | — | — | — | A | 0.25 | P |
| 26 | 100 | 2.0 | 0.8 | A | 0.15 | N | 0.2 | — | — | A | 0.05 | N |
| 27 | 100 | 2.0 | 0.8 | A | 0.20 | N | 0.2 | — | — | N | 0.20 | P |
| 28 | 100 | 2.0 | 0.8 | A | 0.20 | N | 0.2 | — | — | O | 0.20 | P |
| 29 | 100 | 2.0 | 0.8 | A | 0.20 | — | — | — | — | N | 0.40 | P |
| 30 | 100 | 2.0 | 0.8 | A | 0.40 | N | 0.2 | — | — | P | 0.20 | — |
| 31 | 100 | 2.0 | 0.8 | A | 0.20 | B | 0.2 | — | — | N | 0.20 | P |
| 32 | 100 | 2.0 | 0.8 | A | 0.40 | — | — | — | — | N | 0.35 | — |
| 33 | 100 | 2.0 | 0.8 | A | 0.20 | — | — | — | — | N | 0.55 | — |
| 34 | 100 | 2.0 | 0.8 | A | 0.60 | — | — | — | — | N | 0.15 | — |
| 35 | 100 | 2.0 | 0.8 | A | 0.40 | — | — | — | — | N | 0.30 | — |
| 36 | 100 | 2.0 | 0.8 | A | 0.20 | — | — | — | — | N | 0.50 | — |
| 37 | 100 | 2.0 | 0.8 | A | 0.35 | N | 0.35 | — | — | — | — | — |
| 38 | 100 | 2.0 | 0.8 | A | 0.10 | O | 0.35 | N | 0.35 | — | — | — |
| 39 | 100 | 2.0 | 0.8 | A | 0.20 | N | 0.20 | — | — | N | 0.15 | O |
| 40 | 100 | 2.0 | 0.8 | A | 0.06 | — | — | — | — | N | 0.42 | O |
| 41 | 100 | 2.0 | 0.8 | A | 0.20 | — | — | — | — | N | 0.50 | — |
| 42 | 100 | 2.0 | 0.8 | A | 0.60 | — | — | — | — | N | 0.10 | — |
| 43 | 100 | 2.0 | 0.8 | N | 0.40 | — | — | — | — | N | 0.35 | — |
| 44 | 100 | 2.0 | 0.8 | N | 0.40 | — | — | — | — | N | 0.30 | — |
| 45 | 100 | 2.0 | 0.8 | A | 0.40 | — | — | — | — | N | 0.40 | — |

| | (b) Lubricant | | | | | | | (c) | | (d) | |
|---|---|---|---|---|---|---|---|---|---|---|---|
| | (b2) Free lubricant | | | | | | | Carbon | | | |
| | Lubricant 5 | Lubricant 6 | | | | | | black | | Carbonate | |
| No. | Addition amount* (parts by mass) | Type | Addition amount* (parts by mass) | R1 (%) | R2 (—) | R3* (parts by mass) | R4 (%) | Addition amount* (parts by mass) | Type | Addition amount* (parts by mass) | Remarks |
| 23 | 0.20 | — | — | 5 | 19.0 | 0 | 95 | — | — | — | Comparative Example |
| 24 | 0.20 | — | — | — | 1.0 | 0 | 100 | — | — | — | Comparative Example |
| 25 | 0.07 | — | — | 91 | 0.7 | 0.25 | 9 | — | — | — | Comparative Example |
| 26 | 0.20 | P | 0.20 | 25 | 1.3 | 0.05 | 75 | — | — | — | Example |
| 27 | 0.20 | — | — | 25 | 1.0 | 0 | 75 | — | — | — | Example |
| 28 | 0.20 | — | — | 25 | 1.0 | 0 | 75 | — | — | — | Example |
| 29 | 0.20 | — | — | 25 | 3.0 | 0 | 75 | — | — | — | Example |
| 30 | — | — | — | 50 | 0.3 | 0 | 50 | — | — | — | Example |
| 31 | 0.20 | — | — | 50 | 1.0 | 0 | 50 | — | — | — | Example |
| 32 | — | — | — | 53 | 0.9 | 0 | 47 | 0.05 | — | — | Example |
| 33 | — | — | — | 27 | 2.8 | 0 | 73 | 0.05 | — | — | Example |
| 34 | — | — | — | 80 | 0.3 | 0 | 20 | 0.05 | — | — | Example |
| 35 | — | — | — | 57 | 0.8 | 0 | 43 | — | Calcium carbonate | 0.10 | Example |
| 36 | — | — | — | 29 | 2.5 | 0 | 71 | — | Calcium carbonate | 0.10 | Example |
| 37 | — | — | — | 50 | 0 | 0 | 50 | — | Calcium carbonate | 0.10 | Example |

TABLE 3-continued

| | | | | | | | | | | | |
|---|---|---|---|---|---|---|---|---|---|---|---|
| 38 | — | — | — | 13 | 0 | 0 | 88 | — | Calcium carbonate | 0.10 | Example |
| 39 | 0.15 | — | — | 29 | 0.8 | 0 | 71 | — | Calcium carbonate | 0.10 | Example |
| 40 | 0.42 | — | — | 7 | 14.0 | 0 | 93 | — | Calcium carbonate | 0.10 | Example |
| 41 | — | — | — | 29 | 2.5 | 0 | 71 | — | Magnesium carbonate | 0.10 | Example |
| 42 | — | — | — | 86 | 0.2 | 0 | 14 | — | Calcium carbonate | 0.10 | Example |
| 43 | — | — | — | 0 | 0.9 | 0 | 100 | 0.05 | — | — | Comparative Example |
| 44 | — | — | — | 0 | 0.8 | 0 | 100 | — | Calcium carbonate | 0.10 | Comparative Example |
| 45 | — | — | — | 50 | 1.0 | 0 | 50 | — | — | — | Comparative Example |

*Amount with respect to 100 parts by mass of iron-based powder.

TABLE 4

| | Mixed powder for powder metallurgy | | During compaction | Green | |
|---|---|---|---|---|---|
| No. | Apparent density (g/cm$^3$) | Fluidity (sec/50 g) | Ejection force (MPa) | compact Density (g/cm$^3$) | Remarks |
| 1 | 3.20 | 28 | 13.2 | 7.16 | Example |
| 2 | 3.19 | 28 | 13.2 | 7.17 | Example |
| 3 | 3.18 | 29 | 13.0 | 7.15 | Example |
| 4 | 3.17 | 29 | 13.2 | 7.17 | Example |
| 5 | 3.22 | 27 | 12.9 | 7.16 | Example |
| 6 | 3.10 | 30 | 13.1 | 7.17 | Example |
| 7 | 3.11 | 30 | 13.2 | 7.17 | Example |
| 8 | 3.11 | 30 | 13.1 | 7.16 | Example |
| 9 | 3.10 | 30 | 12.8 | 7.21 | Example |
| 10 | 3.09 | 30 | 12.8 | 7.21 | Example |
| 11 | 3.20 | 28 | 14.0 | 7.21 | Example |
| 12 | 3.21 | 28 | 14.2 | 7.20 | Example |
| 13 | 3.22 | 27 | 14.5 | 7.19 | Example |
| 14 | 3.11 | 31 | 14.0 | 7.16 | Example |
| 15 | 3.20 | 28 | 14.0 | 7.19 | Example |
| 16 | 3.14 | 28 | 13.5 | 7.19 | Example |
| 17 | 3.23 | 27 | 13.0 | 7.19 | Example |
| 18 | 3.21 | 28 | 12.9 | 7.21 | Example |
| 19 | 3.16 | 28 | 12.8 | 7.21 | Example |
| 20 | 3.21 | 29 | 12.8 | 7.21 | Example |
| 21 | 3.00 | 29 | 12.4 | 7.21 | Example |
| 22 | 3.00 | 32 | 13.0 | 7.19 | Example |

TABLE 5

| | Mixed powder for powder metallurgy | | During compaction | Green | |
|---|---|---|---|---|---|
| No. | Apparent density (g/cm$^3$) | Fluidity (sec/50 g) | Ejection force (MPa) | compact Density (g/cm$^3$) | Remarks |
| 23 | 3.20 | 29 | 15.0 | 7.15 | Comparative Example |
| 24 | 3.25 | 26 | 15.5 | 7.12 | Comparative Example |
| 25 | 3.00 | Not flow | 11.5 | 7.22 | Comparative Example |
| 26 | 3.09 | 31 | 13.9 | 7.18 | Example |
| 27 | 3.24 | 26 | 14.0 | 7.16 | Example |
| 28 | 3.23 | 26 | 13.8 | 7.19 | Example |
| 29 | 3.22 | 27 | 13.8 | 7.17 | Example |
| 30 | 3.35 | 26 | 15.3 | 7.21 | Example |
| 31 | 3.19 | 28 | 13.1 | 7.17 | Example |
| 32 | 3.10 | 28 | 13.8 | 7.23 | Example |
| 33 | 3.07 | 28 | 13.7 | 7.23 | Example |
| 34 | 3.06 | 28 | 13.6 | 7.20 | Example |
| 35 | 3.15 | 26 | 13.2 | 7.23 | Example |

TABLE 5-continued

| | Mixed powder for powder metallurgy | | During compaction | Green | |
|---|---|---|---|---|---|
| No. | Apparent density (g/cm$^3$) | Fluidity (sec/50 g) | Ejection force (MPa) | compact Density (g/cm$^3$) | Remarks |
| 36 | 3.13 | 26 | 13.2 | 7.23 | Example |
| 37 | 3.30 | 24 | 14.5 | 7.22 | Example |
| 38 | 3.27 | 25 | 14.4 | 7.21 | Example |
| 39 | 3.17 | 28 | 14.0 | 7.23 | Example |
| 40 | 3.06 | 30 | 14.5 | 7.22 | Example |
| 41 | 3.09 | 27 | 14.5 | 7.20 | Example |
| 42 | 3.11 | 26 | 13.2 | 7.24 | Example |
| 43 | 3.13 | 26 | 16.1 | 7.15 | Comparative Example |
| 44 | 3.18 | 25 | 15.4 | 7.15 | Comparative Example |
| 45 | 2.86 | Not flow | 12.9 | 7.22 | Comparative Example |

Second Example

Mixed powders for powder metallurgy were prepared by the same procedure as in the first example, and the properties of each obtained mixed powder for powder metallurgy and the properties of a green compact prepared using the mixed powder for powder metallurgy were evaluated. Here, copper powder and graphite powder were not used. Instead of a pure iron powder, an alloyed steel powder (JIP SIGMAROY 415S produced by JFE Steel Corporation) prepared with an atomizing method was used as the iron-based powder. The alloyed steel powder is a partially diffusion-alloyed steel powder obtained by diffusionally adhering Cu to the surface of an iron powder. The median size D50 of the alloyed steel powder was 80 μm. The respective addition amounts of the components in each mixed powder are shown in Table 6.

For each obtained mixed powder for powder metallurgy, the apparent density, the fluidity, the ejection force during compaction, and the density of the green compact were evaluated by the same procedures as in the first example. The measurement results are shown in Table 7.

As can be seen from the results shown in Table 7, each of the mixed powders of the examples satisfying the conditions according to the present disclosure combined all of the fluidity of the mixed powder, the ejection properties during compaction, and the compressibility of the green compact. On the other hand, each of the mixed powders of the comparative examples not satisfying the conditions according to the present disclosure was inferior in at least one of the fluidity of the mixed powder, the ejection properties during compaction, and the green compact. The results in the first and second examples demonstrate that each mixed powder satisfying the conditions according to the present disclosure had excellent effects regardless of whether the iron-based powder was an iron powder or an alloyed steel powder. The results also demonstrate that each mixed powder satisfying the conditions according to the present disclosure had excellent effects regardless of whether an alloying powder was contained.

TABLE 6

| | | (b) Lubricant | | | | | | | | | |
|---|---|---|---|---|---|---|---|---|---|---|---|
| | | (b1) Binding lubricant | | | | | | (b2) Free lubricant | | | |
| | (a) | Lubricant 1 | | Lubricant 2 | | Lubricant 3 | | Lubricant 4 | | Lubricant 5 | |
| No. | Iron-based powder (parts by mass) | Type | Addition amount* (parts by mass) | Type | Addition amount* (parts by mass) | Type | Addition amount* (parts by mass) | Type | Addition amount* (parts by mass) | Type | Addition amount* (parts by mass) |
| 46 | 100 | A | 0.40 | — | — | — | — | N | 0.20 | P | 0.20 |
| 47 | 100 | A | 0.10 | — | — | — | — | N | 0.50 | P | 0.20 |
| 48 | 100 | A | 0.10 | 0 | 0.25 | N | 0.25 | P | 0.20 | — | — |
| 49 | 100 | A | 0.04 | — | — | — | — | N | 0.56 | P | 0.20 |
| 50 | 100 | N | 0.40 | — | — | — | — | N | 0.20 | P | 0.20 |
| 51 | 100 | A | 0.48 | — | — | — | — | A | 0.25 | P | 0.07 |
| 52 | 100 | A | 0.40 | — | — | — | — | N | 0.35 | — | — |
| 53 | 100 | A | 0.40 | — | — | — | — | N | 0.30 | — | — |
| 54 | 100 | A | 0.10 | 0 | 0.35 | N | 0.35 | O | 0.15 | N | 0.15 |
| 55 | 100 | A | 0.40 | — | — | — | — | N | 0.40 | — | — |

| | (b) Lubricant | | | | | | (c) | | | |
|---|---|---|---|---|---|---|---|---|---|---|
| | (b2) Free lubricant Lubricant 6 | | | | | | Carbon black | (d) Carbonate | | |
| No. | Type | Addition amount* (parts by mass) | R1 (%) | R2 (—) | R3* (parts by mass) | R4 (%) | Addition amount* (parts by mass) | Type | Addition amount* (parts by mass) | Remarks |
| 46 | — | — | 50 | 1.0 | 0 | 50 | — | — | — | Example |
| 47 | — | — | 13 | 7.0 | 0 | 88 | — | — | — | Example |
| 48 | — | — | 13 | 0.3 | 0 | 88 | — | — | — | Example |
| 49 | — | — | 5 | 19.0 | 0 | 95 | — | — | — | Comparative Example |
| 50 | — | — | 0 | 1.0 | 0 | 100 | — | — | — | Comparative Example |
| 51 | — | — | 91 | 0.7 | 0.25 | 9 | — | — | — | Comparative Example |
| 52 | — | — | 53 | 0.9 | 0 | 47 | 0.05 | — | — | Example |
| 53 | — | — | 57 | 0.8 | 0 | 43 | — | Calcium carbonate | 0.10 | Example |
| 54 | — | — | 9 | 0.4 | 0 | 91 | — | Calcium carbonate | 0.10 | Example |
| 55 | — | — | 50 | 1.0 | 0 | 50 | — | — | — | Comparative Example |

*Amount with respect to 100 parts by mass of iron-based powder.

TABLE 7

| | Mixed powder for powder metallurgy | | During compaction | Green | |
|---|---|---|---|---|---|
| No. | Apparent density (g/cm$^3$) | Fluidity (sec/50 g) | Ejection force (MPa) | compact Density (g/cm$^3$) | Remarks |
| 46 | 2.99 | 31 | 16.2 | 7.13 | Example |
| 47 | 2.90 | 34 | 17.0 | 7.07 | Example |
| 48 | 3.08 | 31 | 17.0 | 7.10 | Example |
| 49 | 3.08 | 32 | 18.0 | 7.06 | Comparative Example |

TABLE 7-continued

| | Mixed powder for powder metallurgy | | During compaction | Green | |
|---|---|---|---|---|---|
| No. | Apparent density (g/cm$^3$) | Fluidity (sec/50 g) | Ejection force (MPa) | compact Density (g/cm$^3$) | Remarks |
| 50 | 3.04 | 29 | 18.5 | 7.09 | Comparative Example |
| 51 | 2.79 | Not flow | 14.5 | 7.19 | Comparative Example |
| 52 | 2.89 | 31 | 16.8 | 7.20 | Example |
| 53 | 2.94 | 28 | 16.2 | 7.20 | Example |

TABLE 7-continued

| No. | Mixed powder for powder metallurgy: Apparent density (g/cm$^3$) | Mixed powder for powder metallurgy: Fluidity (sec/50 g) | During compaction: Ejection force (MPa) | Green compact Density (g/cm$^3$) | Remarks |
|---|---|---|---|---|---|
| 54 | 3.15 | 28 | 17.4 | 7.18 | Example |
| 55 | 2.65 | Not flow | 15.9 | 7.19 | Comparative Example |

Third Example

Mixed powders for powder metallurgy were prepared by the same procedure as in the first example. The respective addition amounts of the components in each mixed powder are shown in Table 8.

Next, using each obtained mixed powder for powder metallurgy, the ejection force and the density of the green compact were evaluated by the same procedure as in the first example under the following two conditions: the die temperature during compaction was normal temperature; and the die temperature during compaction was 80° C. The measurement results are shown in Table 9.

As can be seen from the results shown in Table 9, each of the mixed powders of the examples satisfying the conditions according to the present disclosure had better ejection properties and compressibility than those of the comparative examples in the case where the die temperature was normal temperature. The mixed powder of No. 56 containing a fatty acid monoamide having a melting point of 80° C. or more and the mixed powder of No. 59 containing a fatty acid having a melting point of 75° C. or more exhibited excellent ejection properties and compressibility in the case where the die temperature was 80° C., too.

TABLE 8

| | (a) | (e) | | (b) Lubricant | | | | | | |
|---|---|---|---|---|---|---|---|---|---|---|
| | | | | (b1) Binding lubricant | | | | | | |
| | | | | Lubricant 1 | | Lubricant 2 | | Lubricant 3 | | |
| | Iron-based | Alloying powder | | | Addition | | Addition | | Addition | |
| No. | powder (parts by mass) | Copper* (parts by mass) | Graphite* (parts by mass) | Type | amount* (parts by mass) | Type | amount* (parts by mass) | Type | amount* (parts by mass) | (b2) Free lubricant Lubricant 4 Type |
| 56 | 100 | 2.0 | 0.8 | A | 0.40 | — | — | — | — | N |
| 57 | 100 | 2.0 | 0.8 | B | 0.40 | — | — | — | — | N |
| 58 | 100 | 2.0 | 0.8 | C | 0.40 | — | — | — | — | N |
| 59 | 100 | 2.0 | 0.8 | D | 0.40 | — | — | — | — | N |
| 60 | 100 | 2.0 | 0.8 | N | 0.40 | — | — | — | — | N |

| | (b) Lubricant | | | | | | | | | |
|---|---|---|---|---|---|---|---|---|---|---|
| | (b2) Free lubricant | | | | | | | | | |
| | Lubricant 4 | | Lubricant 5 | | Lubricant 6 | | | | | |
| No. | Addition amount* (parts by mass) | Type | Addition amount* (parts by mass) | Type | Addition amount* (parts by mass) | R1 (%) | R2 (-) | R3* (parts by mass) | R4 (%) | Remarks |
| 56 | 0.20 | P | 0.20 | — | — | 50 | 1.0 | 0 | 50 | Example |
| 57 | 0.20 | P | 0.20 | — | — | 50 | 1.0 | 0 | 50 | Example |
| 58 | 0.20 | P | 0.20 | — | — | 50 | 1.0 | 0 | 50 | Example |
| 59 | 0.20 | P | 0.20 | — | — | 50 | 1.0 | 0 | 50 | Example |
| 60 | 0.20 | P | 0.20 | — | — | 0 | 1.0 | 0 | 100 | Comparative Example |

*Amount with respect to 100 parts by mass of iron-based powder.

TABLE 9

| No. | Die temperature: normal temperature During compaction Ejection force (MPa) | Die temperature: normal temperature Green compact Density (g/cm$^3$) | Die temperature: 80° C. During compaction Ejection force (MPa) | Die temperature: 80° C. Green compact Density (g/cm$^3$) | Remarks |
|---|---|---|---|---|---|
| 56 | 13.2 | 7.16 | 11.2 | 7.20 | Example |
| 57 | 13.2 | 7.17 | 13.2 | 7.21 | Example |
| 58 | 13.0 | 7.15 | 13.0 | 7.19 | Example |
| 59 | 13.2 | 7.17 | 11.2 | 7.21 | Example |
| 60 | 15.5 | 7.12 | 15.4 | 7.18 | Comparative Example |

The invention claimed is:

1. A mixed powder for powder metallurgy, comprising:

an (a) iron-based powder; and a (b) lubricant, wherein the (b) lubricant contains a fatty acid metal soap, the (b) lubricant consists of a low-melting-point lubricant having a melting point of 86° C. or less and a high-melting-point lubricant having a melting point of more than 86° C., the low-melting-point lubricant is at least one of a fatty acid monoamide having a melting point of 80° C. or more and a fatty acid having a melting point of 75° C. or more, the low-melting-point lubricant has at least one selected from the group consisting of an amide group, an ester group, an amino group, and a carboxyl group, a ratio R1 of the low-melting-point lubricant to whole of the (b) lubricant is 5 mass % or more and less than 90 mass %, a ratio R2 of a mass of a (b2) free lubricant to a mass of a (b1) binding lubricant is 0 or more and 15 or less, where the (b1) binding lubricant is the (b) lubricant adhering to a surface of the (a) iron-based powder, and the (b2) free lubricant is the (b) lubricant not adhering to the surface of the (a) iron-based powder, and an amount R3 of the low-melting-point lubricant contained as the (b2) free lubricant is less than 0.10 parts by mass with respect to 100 parts by mass of the iron-based powder.

2. The mixed powder for powder metallurgy according to claim 1, wherein the (b1) binding lubricant and the (b2) free lubricant contain a fatty acid derivative having at least one of an alkyl group having a carbon number of 11 or more and an alkenyl group having a carbon number of 11 or more.

3. The mixed powder for powder metallurgy according to claim 1, wherein a lubricant having a melting point of 100° C. or more is contained as the high-melting-point lubricant, and a ratio R4 of the lubricant having a melting point of 100° C. or more to the whole of the (b) lubricant is 10 mass % or more.

4. The mixed powder for powder metallurgy according to claim 1, wherein the high-melting-point lubricant is at least one selected from the group consisting of a fatty acid amide, a fatty acid metal soap, and a mixture thereof.

5. The mixed powder for powder metallurgy according to claim 1, wherein the low-melting-point lubricant is a monoamide having a fatty chain containing an unsaturated bond.

6. The mixed powder for powder metallurgy according to claim 1, further comprising one or both of an (e) alloying powder and a (f) machinability improver.

7. The mixed powder for powder metallurgy according to claim 6, wherein one or both of the (e) alloying powder and the (f) machinability improver are adhered to the surface of the (a) iron-based powder via the (b1) binding lubricant.

8. A mixed powder for powder metallurgy, comprising:

an (a) iron-based powder;

a (b) lubricant; and at least one of (c) carbon black and a (d) carbonate, wherein the (b) lubricant does not contain a fatty acid metal soap, the (b) lubricant consists of a low-melting-point lubricant having a melting point of 86° C. or less and a high-melting-point lubricant having a melting point of more than 86° C., the low-melting-point lubricant has at least one selected from the group consisting of an amide group, an ester group, an amino group, and a carboxyl group, a ratio R1 of the low-melting-point lubricant to whole of the (b) lubricant is 5 mass % or more and less than 90 mass %, a ratio R2 of a mass of a (b2) free lubricant to a mass of a (b1) binding lubricant is 0 or more and 15 or less, where the (b1) binding lubricant is the (b) lubricant adhering to a surface of the (a) iron-based powder, and the (b2) free lubricant is the (b) lubricant not adhering to the surface of the (a) iron-based powder, and an amount R3 of the low-melting-point lubricant contained as the (b2) free lubricant is less than 0.10 parts by mass with respect to 100 parts by mass of the iron-based powder.

9. The mixed powder for powder metallurgy according to claim 8, wherein the (b1) binding lubricant and the (b2) free lubricant contain a fatty acid derivative having at least one of an alkyl group having a carbon number of 11 or more and an alkenyl group having a carbon number of 11 or more.

10. The mixed powder for powder metallurgy according to claim 8, wherein a lubricant having a melting point of 100° C. or more is contained as the high-melting-point lubricant, and a ratio R4 of the lubricant having a melting point of 100° C. or more to the whole of the (b) lubricant is 10 mass % or more.

11. The mixed powder for powder metallurgy according to claim 8, wherein the high-melting-point lubricant is a fatty acid amide.

12. The mixed powder for powder metallurgy according to claim 8, wherein the low-melting-point lubricant is a monoamide having a fatty chain containing an unsaturated bond.

13. The mixed powder for powder metallurgy according to claim 8, further comprising one or both of an (e) alloying powder and a (f) machinability improver.

14. The mixed powder for powder metallurgy according to claim 13, wherein one or both of the (e) alloying powder and the (f) machinability improver are adhered to the surface of the (a) iron-based powder via the (b1) binding lubricant.

* * * * *